US006390641B1

(12) United States Patent
Liu

(10) Patent No.: US 6,390,641 B1
(45) Date of Patent: May 21, 2002

(54) FLASH TYPE OPTIC PEN

(76) Inventor: Robert Liu, No. 2, Lane 71, Man Ping St., Panchiao, Taipei Hsien (TW)

( * ) Notice: Subject to any disclaimer, the term of this patent is extended or adjusted under 35 U.S.C. 154(b) by 0 days.

(21) Appl. No.: 09/501,989

(22) Filed: Feb. 11, 2000

(51) Int. Cl.[7] ..... B43K 29/10
(52) U.S. Cl. ..... 362/118; 362/109; 362/184
(58) Field of Search ..... 362/109, 118, 362/184, 251, 259, 253, 800, 352; 401/195

(56) References Cited

U.S. PATENT DOCUMENTS 5,036,442 A * 7/1991 Brown ..... 362/800
5,544,967 A * 8/1996 Yao ..... 362/118
5,791,766 A * 8/1998 Lee ..... 362/259

* cited by examiner

*Primary Examiner*—Y. Quach
(74) *Attorney, Agent, or Firm*—Rosenberg, Klein & Lee

(57) ABSTRACT

A flash type optic pen comprises a pen body, a seat and a transparent telescopic head. The pen body is electrically connected to a battery and a switch. The seat is assembled to the front end of the pen body and has at least one circuit board and a plurality of light emitting diodes electrically connected to the circuit board. The transparent telescopic head is formed by a plurality of transparent staged tubes having reducing diameters. Thus, the pen body has the functions of writing and illumination. The light emitting angles, colors, heights and orientations of the light emitting diodes are different. The circuit board is installed with a programmable IC circuit for presetting and controlling the lighting up and extinguishing order of the light emitting diodes. The lights from the light emitting diodes are alternatively changed in a predetermined way or randomly, or flashes overlapped or separately. Viewing the optic pen from the outer side of the transparent telescopic head, it can see that lights of different colors change the positions continuously so as to present a vivid and beautiful visual effect.

6 Claims, 12 Drawing Sheets

FLASH TYPE OPTIC PEN

FIELD OF THE INVENTION

The present invention relates to an optic pen, and especially to a flash type optic pen which is formed as a portable pen with a plurality of light projecting angle, moreover, a plurality of structures and circuits are used so as to present a vivid and beautiful color change effect.

BACKGROUND OF THE INVENTION

With development of photoelectric technology, the expensive and precise photoelectric devices used in defense industry have becomes more and more compact and are used in the life, for example, an optic pen combining a light source and a conventional pen body. The light source used in an optic pen includes laser diodes, and light emitting diodes. For optic pen with laser diodes, the straight laser light is employed in reporting. However, since the laser light is too concentrated, it can not generate the effects of reflecting, transmitting, and refracting in a large area. On the contrary, as shown in FIG. 1, an optic pen 4 with light emitting diodes 40 can provide a preferred visual effect with higher illumination. The visual effect is very finite, because only one light emitting diode is used, the light projecting angle and color are fixed. Therefore, the color and angle of the light projecting to the pen head 41 is invariant. In the whole, it presents a static effect and is dull. Even a multiple color light emitting diode is used, the effect is also finite.

SUMMARY OF THE INVENTION

Accordingly, the primary object of the present invention is to provide a flash type optic pen. Due to the changes of light emitting angles, orientations, heights and colors, the lights from the light emitting diodes are alternatively changed in predetermined ways or randomly, or flash overlapped or separately. Viewing the optic pen from the outside of the transparent telescopic head, it can see that lights of different colors change the positions continuously so as to present a vivid and beautiful visual effect.

Another object of the present invention is to provide a flash type optic pen, wherein light emitting angles colors, heights and orientations of the light emitting diodes are different. A circuit board is installed with a programmable IC circuit for presetting and controlling the lighting up and extinguishing order of the light emitting diodes. The lights from the light emitting diodes are alternatively changed in a predetermined way or randomly, or flashes overlapped or separately.

The various objects and advantages of the present invention will be more readily understood from the following detailed description when read in conjunction with the appended drawing.

DETAILED DESCRIPTION OF THE PREFERRED EMBODIMENTS

Figure 1:
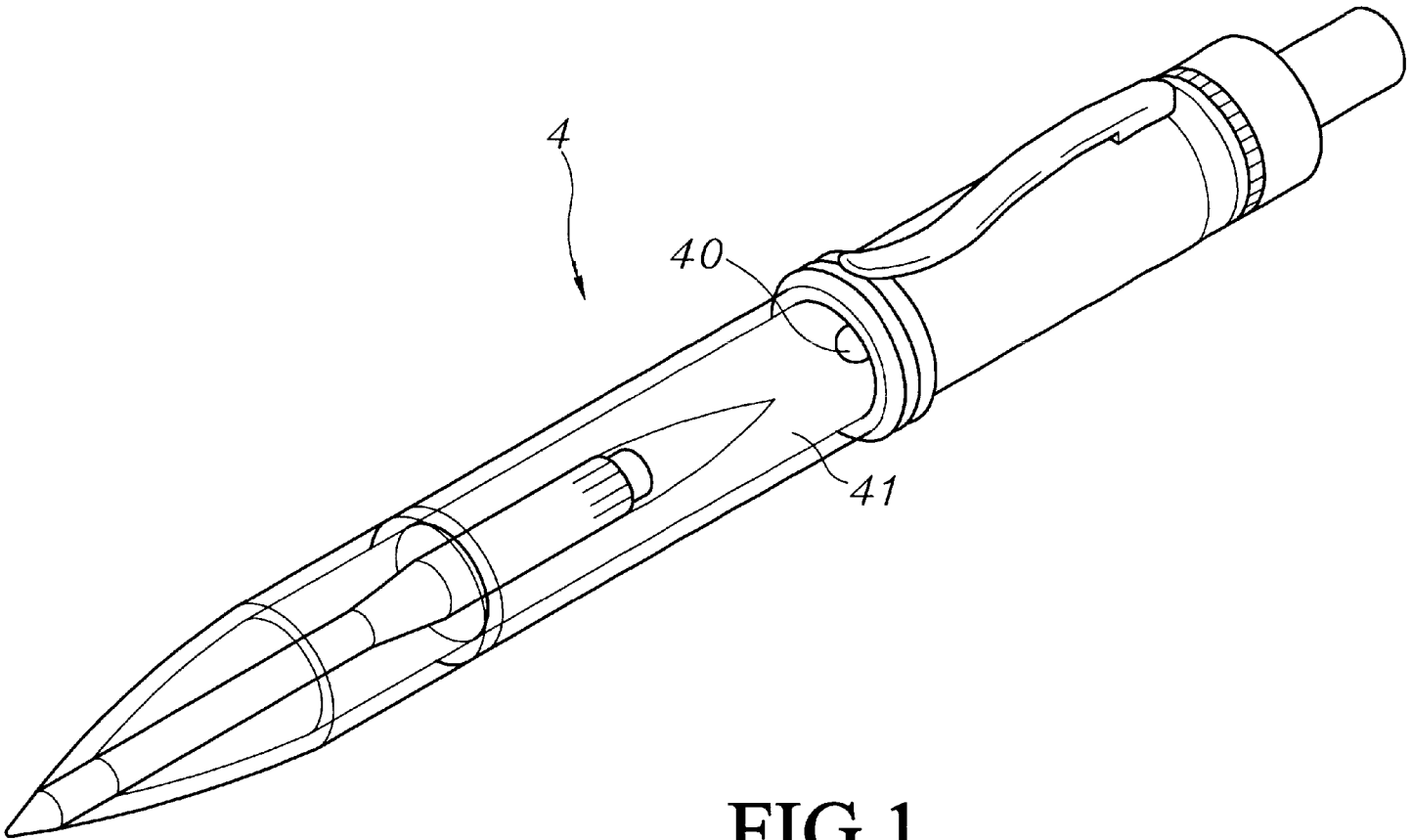
FIG.1 PRIOR ART
FIG. 1 is a perspective view showing a prior art optic pen structure.
Figure 2:
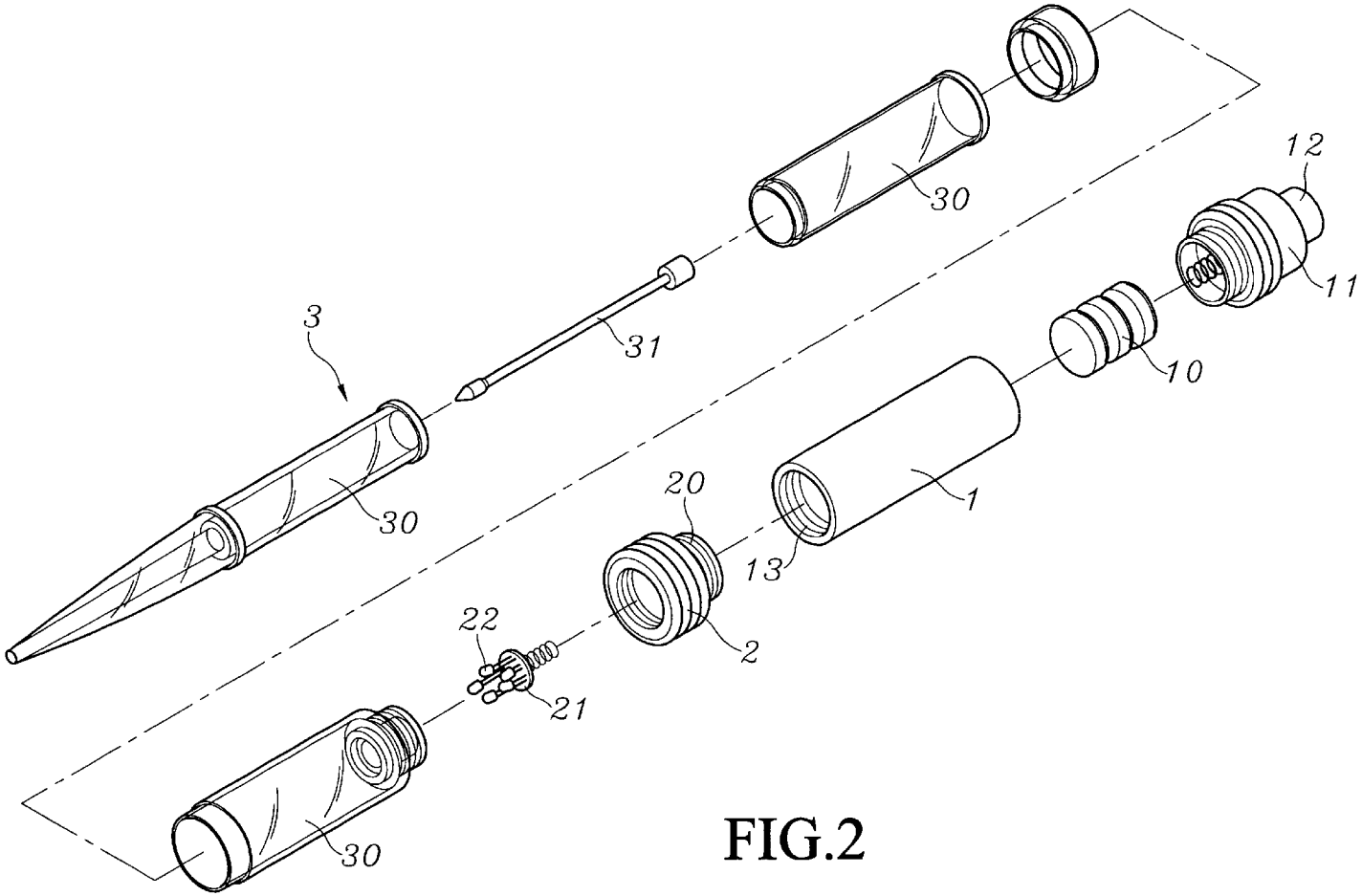
FIG. 2 is an exploded perspective view of the present invention.
Figure 3:
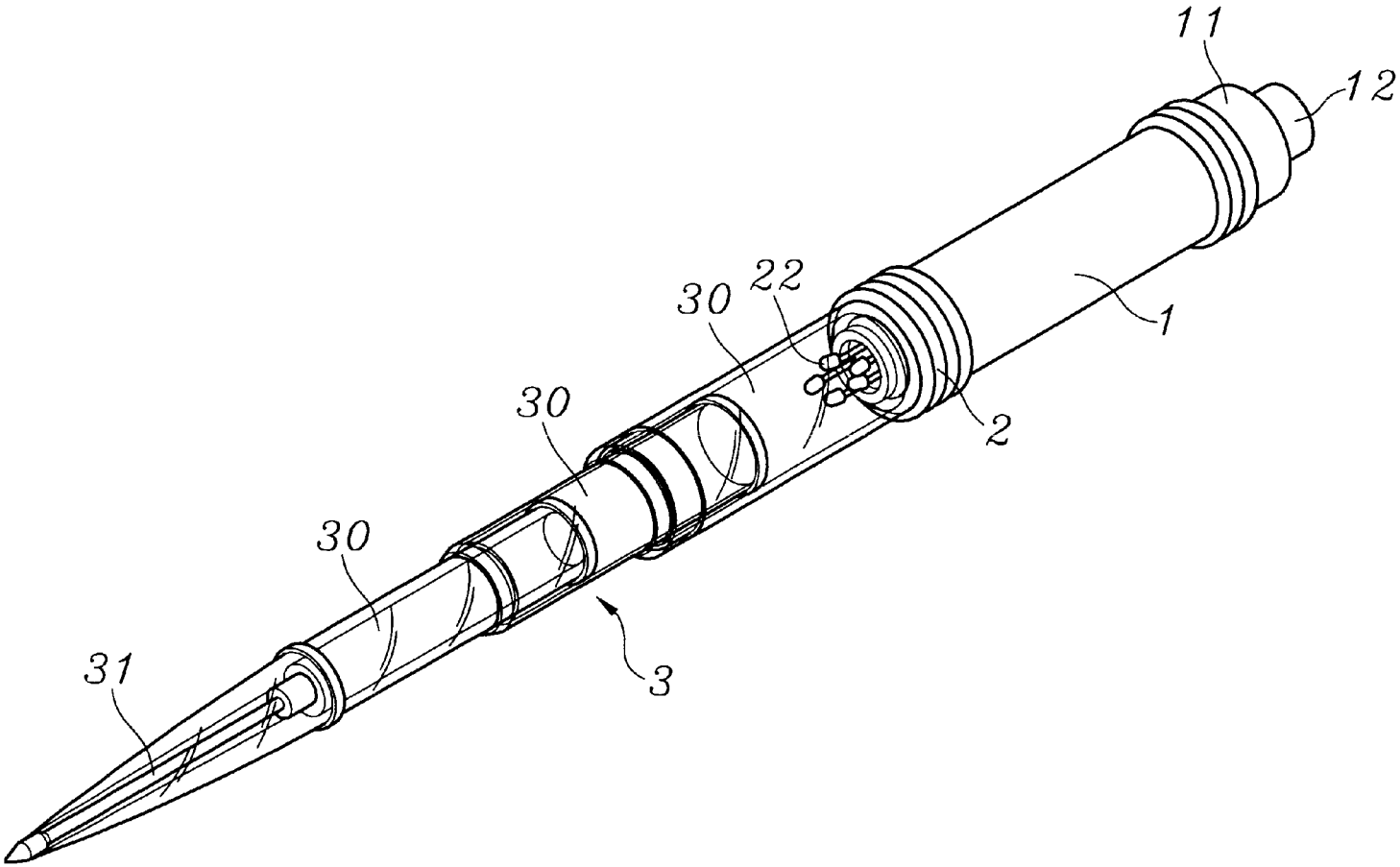
FIG. 3 is an assembled perspective view of the present invention.
Figure 4:
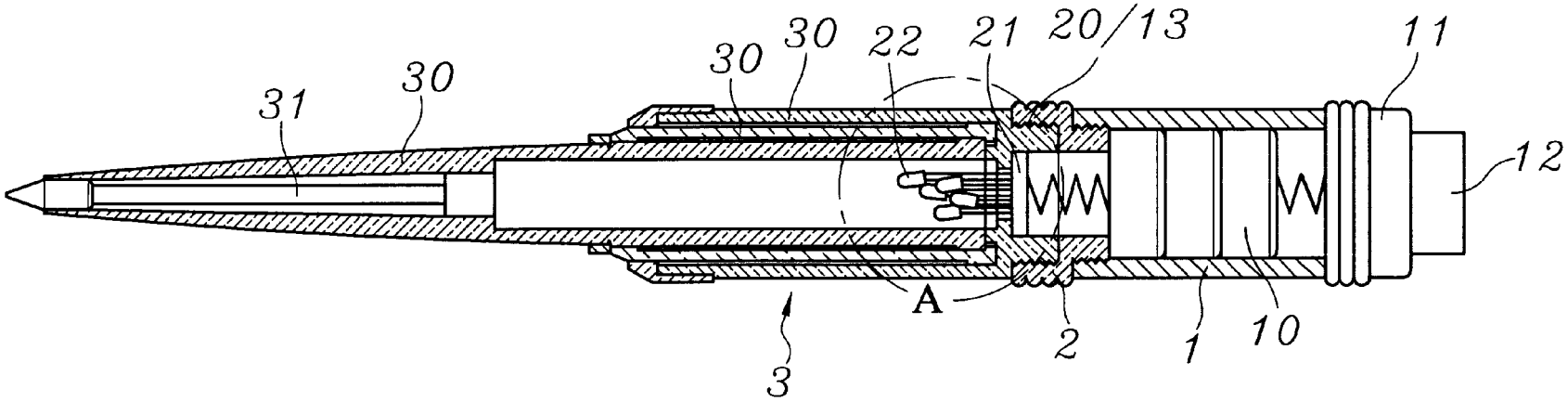
FIG. 4 is an assembled cross sectional view showing that the pen head of the present invention is shorted.

With reference to FIGS. 2 to 4, the exploded and assembled views of a preferred embodiment of the flash type optic pen according to the present invention are illustrated. The optic pen of the present invention includes a pen body 1, a seat 2, and a transparent telescopic head 3.

The pen body 1 is a hollow tube. A battery 10 is installed therewithin, and a distal cover 11 is screwed to seal the pen body. A switch 12 electrically connected the battery 10 is installed at the tube body or the distal cover 11. The circuit loop can be formed by the pen body 1 and the distal cover 11, or an extra metal conductive piece, or other prior art. Besides, the head of the pen body 1 is installed with thread 13 for being screwedly connected to the seat 2 of the thread 20.

Figure 5:
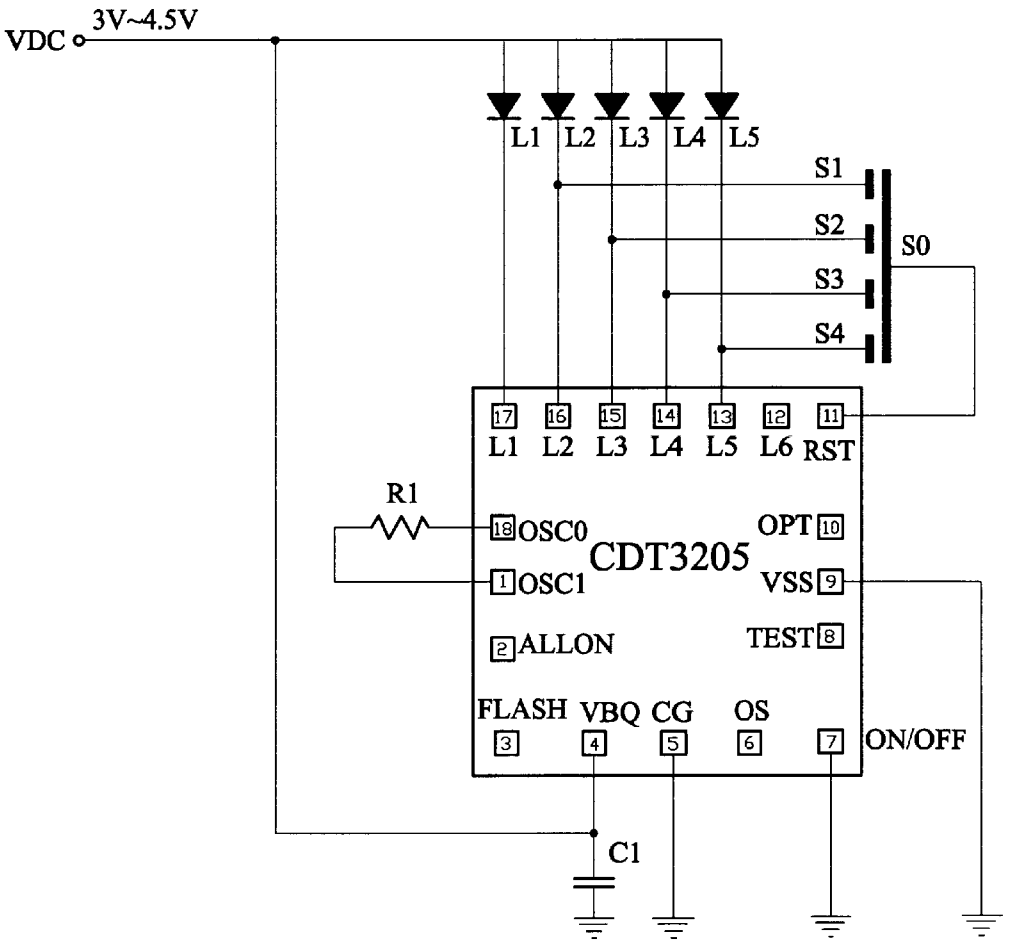
FIG. 5 is a circuit diagram showing one embodiment about the programmable IC circuit in the present invention.
Figure 6:
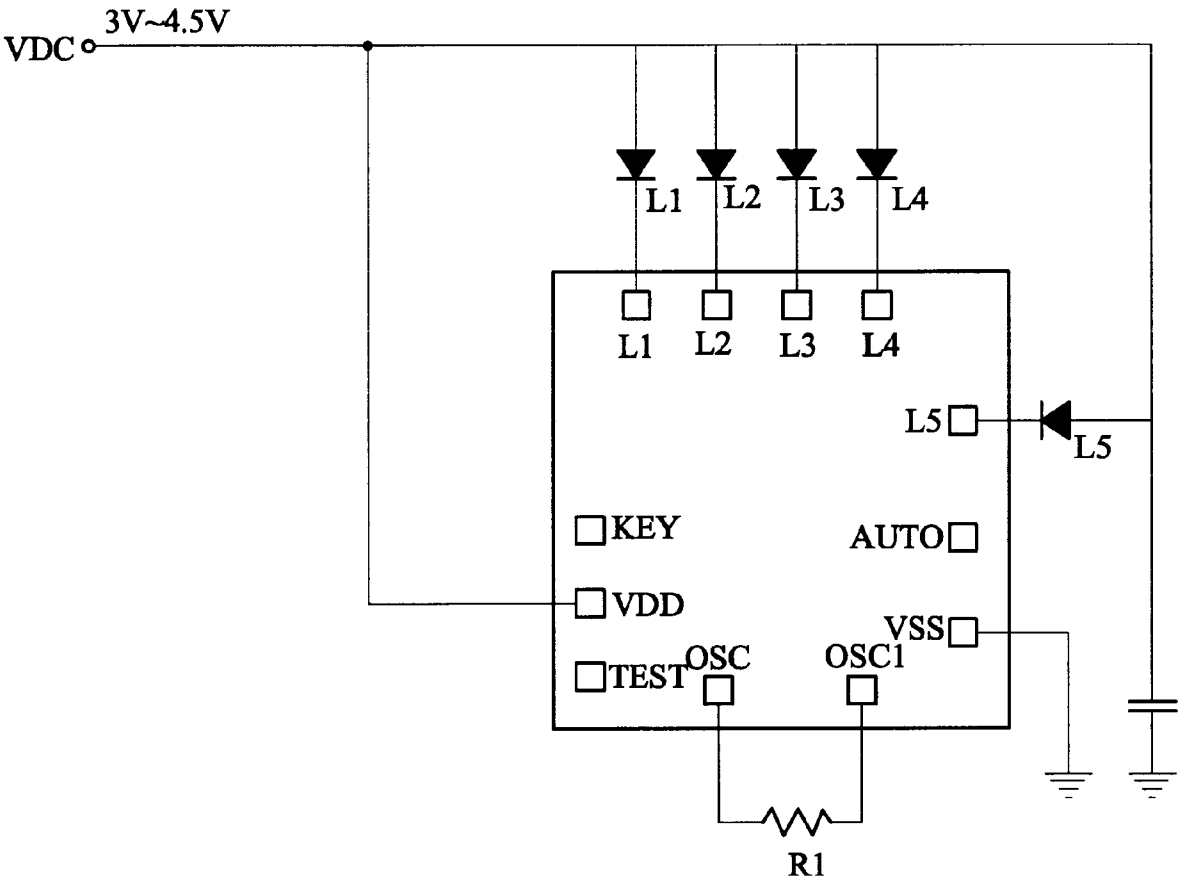
FIG. 6 is a circuit diagram showing another embodiment about the programmable IC circuit in the present invention.
Figure 7:
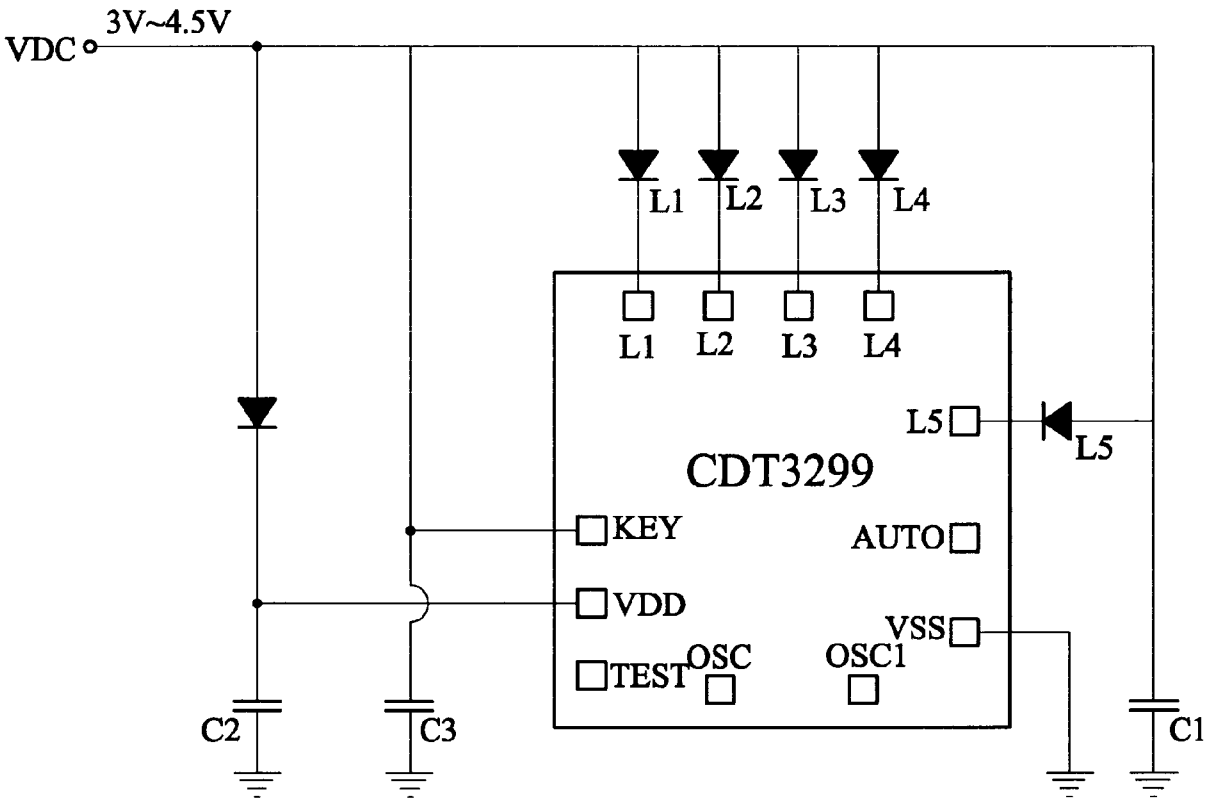
FIG. 7 is a circuit diagram showing one embodiment about the programmable IC circuit in the present invention.
Figure 8:
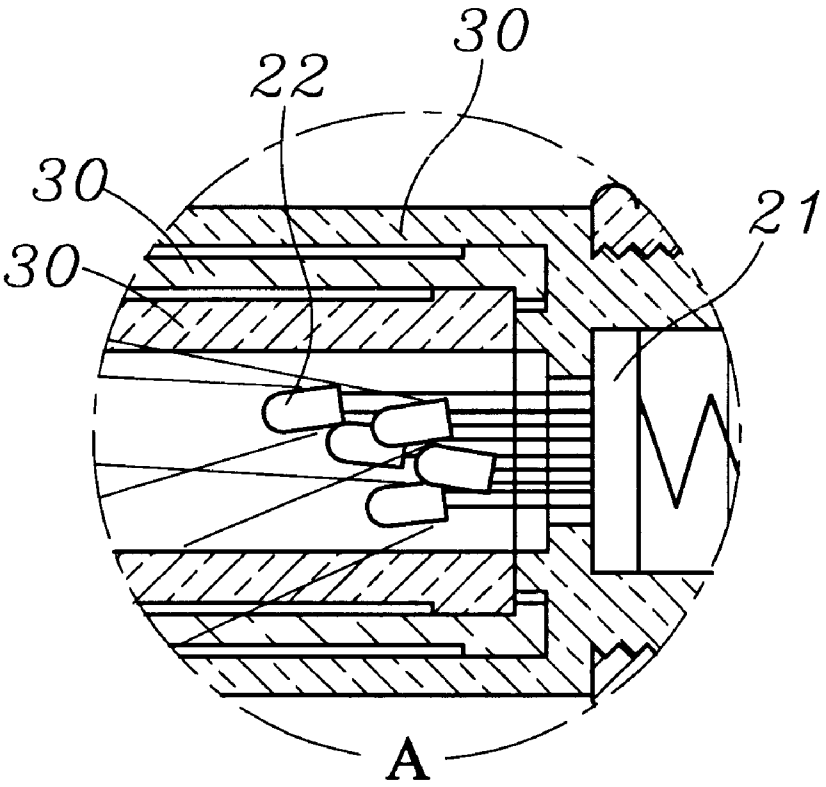
FIG. 8 is an enlarged view showing the seat in FIG. 4.
Figure 11:
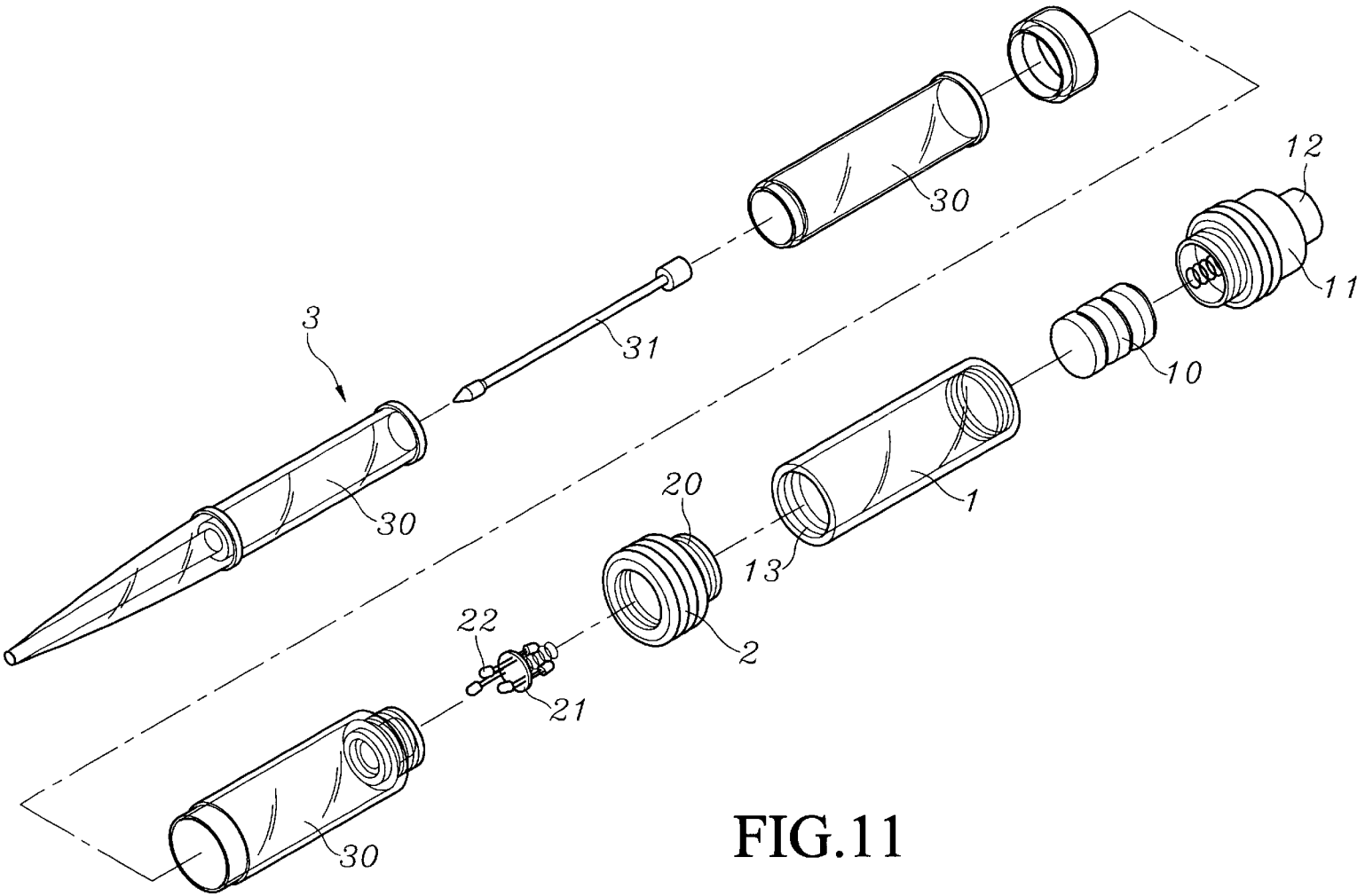
FIG. 11 is an exploded perspective view showing the arrangement of the light emitting diodes in the present invention.
Figure 12:
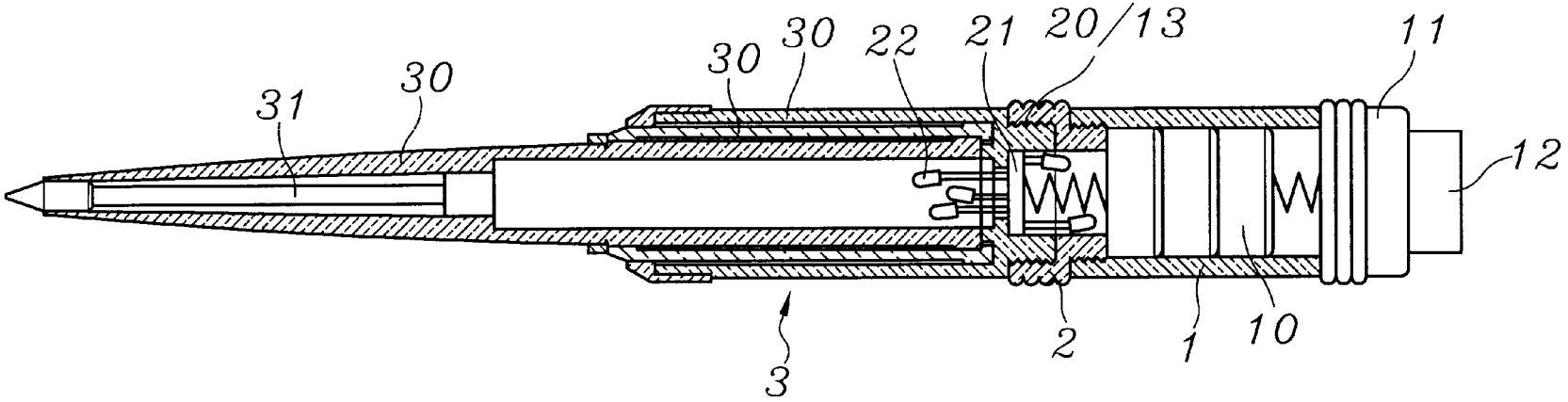
FIG. 12 is an assembled cross sectional view of the present invention with respect to FIG. 11.

The seat 2 is installed with a circuit board 21 electrically connected to the battery 10 and a plurality of light emitting diodes (LED) 22 electrically connected to the circuit board 21. The circuit board 21 is arranged with a programmed IC circuit or a chip for controlling the light emitting diodes 22. FIG. 5 shows one embodiment. By the joints SO to be selectively switched to the joints S1 to S4, the five light emitting diodes 22 (L1~L5) may have many ways for flashing, such as 5, 4, 3, or 2 light emitting diodes lights up. FIG. 6 shows another embodiment of the present invention, wherein a mask ROM is set to switch the light emitting diodes 22 (L1~L5) to present 8 stages, or states for flashing. The eight stages are "single lamp flashes alternatively", "double lamps flash alternatively", "light up all lamps sequentially". "extinguish all lights sequentially", "flash the lamps in an inward order", "flash all the lamps", "flash all lamps, and extinguish all lamps", and "light up gradually and extinguish gradually". Another, FIG. 7 shows another embodiment, the aforesaid eight stages are performed in turn. That is, if the circuit is ON, the first stage for flashing the light emitting diodes is performed. Then, the circuit is OFF and then is ON, the second stage of flashing the light emitting diodes is preformed. Then, the circuit is OFF and is then ON, the third stage for flashing the light emitting diodes is performed. The process is performed in like ways. In the enlarged view of FIG. 8, other than light emitting angles and colors of all the light emitting diodes 22 can be different, the orientations and heights (i.e. the tilting angles and direction) of the light emitting diodes 22 on the circuit board 21 with respective to the circuit board can be changed so that the projecting directions and the beam widths of the light emitting diodes 22 are overlapped with one another. Other than being installed in the front lateral side of the circuit board 21, the light emitting diodes 22 can be distributed at the front side and rear sides, as shown in FIGS. 11 and 12 (for example, three in front side, while two in rear side). Therefore, the pen body 1 is designed like a transparent body.

Figure 9:
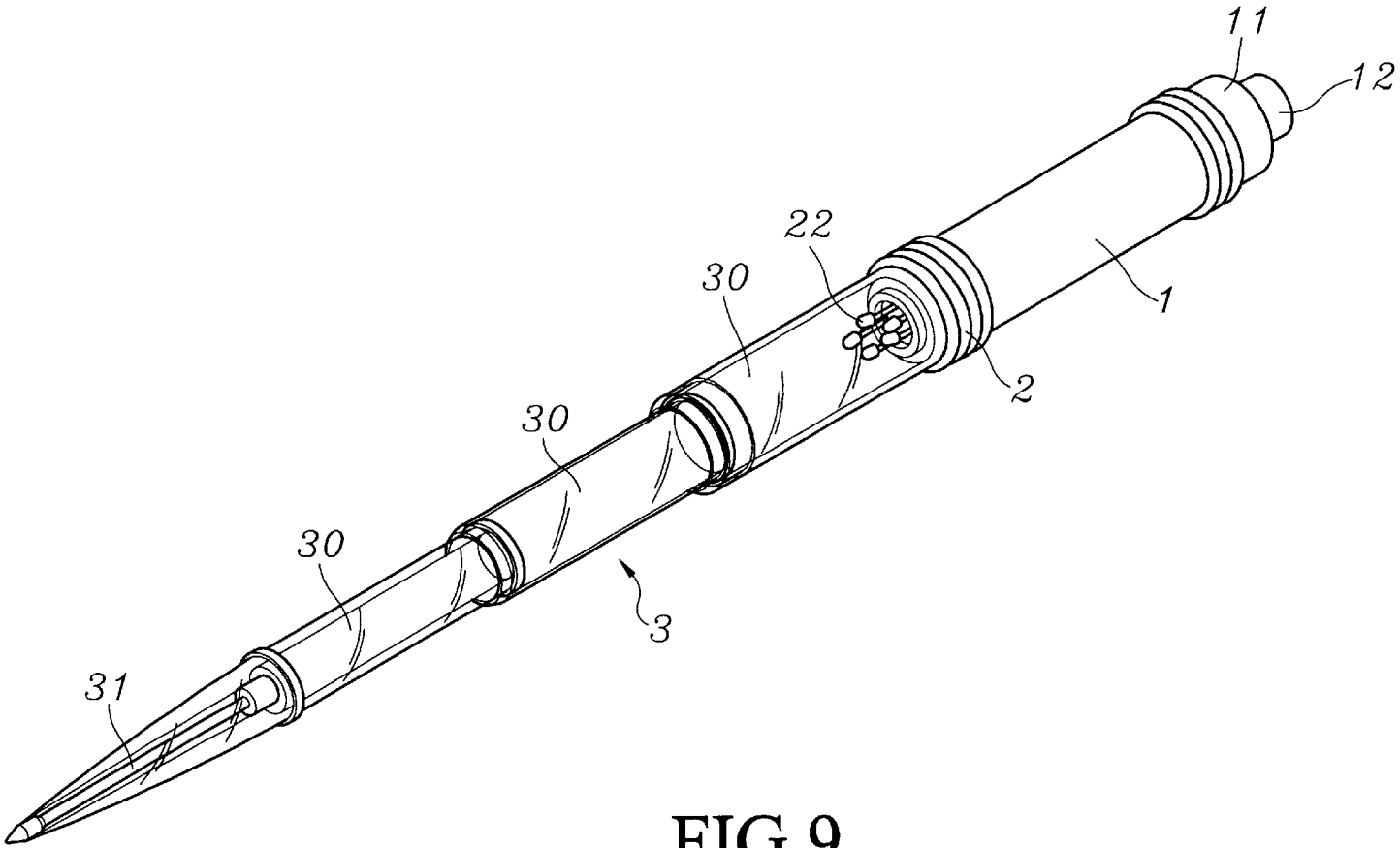
FIG. 9 is a perspective view showing the pen head of the present invention being prolonged.
Figure 10:
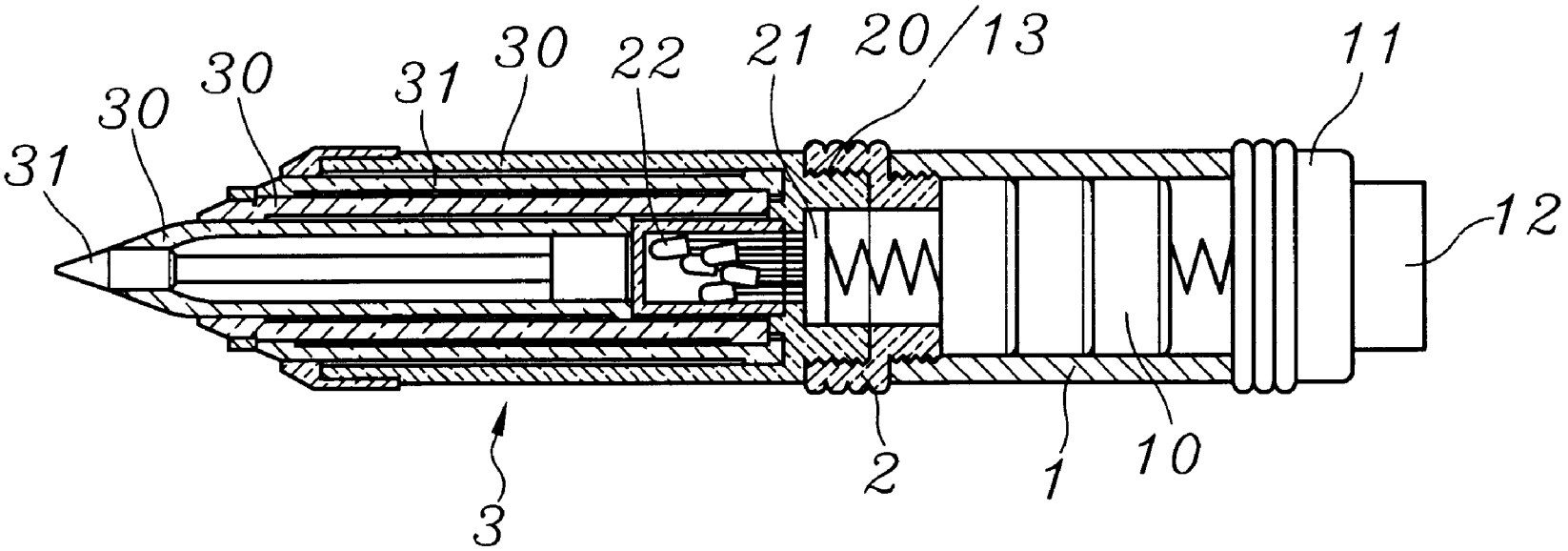
FIG. 10 is an assembled cross sectional view showing a four staged pen head in the present invention which is shorted.

At one end of the pen body 1 near the seat 2 is installed with a transparent telescopic head 3. The transparent telescopic head 3 is designed with three staged tubes 30 with reduced tube diameters (as shown in FIGS. 2 to 4) or with four stage tubes 30 (as shown in FIG. 10) for telescopically adjusting the length of the pen body (such as FIGS. 9, 4, and 10) so that the whole light radiating length and area can be changed. The distal tube 30 can be installed with a central pen structure 31 for writing.

By aforesaid structure, the optic pen of the present invention can be formed as shown in FIGS. 3, 4, 9 and 10. Since light emitting diodes 22 are included in the optic pen, the pen head 3 will emit a very bright light for illumination or presenting an interesting effect. Since the optic pen has a central pen structure 31, it can write. Since the optic pen has a telescopic length. Thus, the length thereof can be increased greatly for amusement. Alternatively, it should be noted that by the preset programmable IC and the logic program in the chip, the lighting up and extinguishing of the light emitting diodes 22 are controlled. Therefore, since the light emitting angles, colors, heights, and orientations of the light emitting diodes are different, and further by the controlling of the IC circuit, the lights from the light emitting diodes 22 are alternatively changed in a predetermined way or randomly, or flashes overlapped or separately. Viewing the optic pen from outer side of the transparent telescopic head, it can see that lights of different colors change the positions continuously so as to present a vivid and beautiful visual effect. Especially, if the transparent telescopic head 3 is prolonged, the effect is more effective. Therefore, the optic pen presents an amused and interesting effect wholly.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A light emitting pen comprising:

(a) a pen body extending longitudinally between first and second end portions thereof;

(b) a battery housed within said pen body;

(c) a switch coupled to said first end portion of said pen body for selectively setting a plurality of predefined light emitting states;

(d) an annular seat coupled to said second end portion of said pen body;

(e) a circuit board coupled to said seat and electrically coupled to said battery and said switch, said circuit board having first and second opposed sides;

(f) a plurality of light emitting diodes coupled to at least one of said first and second circuit board sides, said light emitting diodes being actuable responsive to the selection of at least one of said predefined light emitting states to generate an optical signal corresponding thereto; and, (g) a transparent telescopic head coupled to said seat for transmitting said optical signal generated by said light emitting diodes.

2. The light emitting pen as recited in claim 1 wherein said circuit board includes a programmable integrated circuit device having said predefined light emitting states stored therein, said integrated circuit device being operable to control actuation of said light emitting diodes in accordance with said predefined light emitting states.

3. The light emitting pen as recited in claim 1 wherein said transparent telescopic head includes a plurality of telescopically coupled transparent stage tubes.

4. The light emitting pen as recited in claim 1 further comprising a central pen writing structure disposed adjacent said transparent telescopic head.

5. The light emitting pen as recited in claim 1 wherein at least one of said light emitting diodes is coupled on each of said first and second sides of said circuit board.

6. The light emitting pen as recited in claim 5 wherein said pen body includes a transparent portion for transmitting said optical signal directed thereto.

* * * * *